US010760419B2

(12) United States Patent
Dudson et al.

(10) Patent No.: US 10,760,419 B2
(45) Date of Patent: Sep. 1, 2020

(54) HYDRAULIC HOISTING OF POTASH AND OTHER EVAPORITE ORES

(71) Applicant: Stantec Consulting Ltd., North Bay, Ontario (CA)

(72) Inventors: Eric C. Dudson, North Bay (CA); Richard J. Saccany, Tempe, AZ (US)

(73) Assignee: Stantec Consulting Ltd., North Bay, Ontario (CA)

( * ) Notice: Subject to any disclaimer, the term of this patent is extended or adjusted under 35 U.S.C. 154(b) by 10 days.

(21) Appl. No.: 15/972,553

(22) Filed: May 7, 2018

(65) Prior Publication Data

US 2019/0338627 A1 Nov. 7, 2019

(51) Int. Cl.
*E21C 41/20* (2006.01)
*E21F 13/00* (2006.01)
(Continued)

(52) U.S. Cl.
CPC ..... *E21C 41/20* (2013.01); *E21F 13/00* (2013.01); *B01F 3/1214* (2013.01);
(Continued)

(58) Field of Classification Search
CPC ..... E21C 41/20; E21C 35/20; E21C 41/00; E21C 41/16; E21F 13/042; E21F 13/00; E21F 13/04; B65G 53/30
(Continued)

(56) References Cited

U.S. PATENT DOCUMENTS 616,537 A * 12/1898 Honigmann ..... B65G 53/30 406/106
2,793,082 A * 5/1957 Gardner, Jr. ..... E21F 13/042 406/128
(Continued)

FOREIGN PATENT DOCUMENTS

CN 104314548 1/2015
EP 0184720 A1 * 6/1986 ..... E21C 41/20
(Continued)

OTHER PUBLICATIONS

Shook, CA; Gillies, RG and Schergevitch, PJ. Concentration Changes in Hydraulic Hoisting of Potash Ore [online]. In: International Conference on Bulk Materials Storage, Handling and Transportation (4th : 1992 : Wollongong, N.S.W.). 4th International Conference on Bulk Materials, Storage, Handling and Transportation: 7th International Symposium on Freight Pipelines, Wollongong, Australia; Preprints of Papers; 1992; pp. 185-189; No. 92/7; Institution of Engineers, Australia; Barton, ACT, Australia.
(Continued)

*Primary Examiner* — Janine M Kreck
*Assistant Examiner* — Michael A Goodwin
(74) *Attorney, Agent, or Firm* — Dickinson Wright LLP; Yuri Chumak

(57) ABSTRACT

According to embodiments described in the specification, an exemplary method is disclosed for hydraulically hoisting potash (or other evaporite ore) 'fines' material from an underground mine. The method includes mining an ore
(Continued)

deposit using a boring machine to generate Run-of-Mine (ROM) material at a mine face, conveying the generated ROM material to an underground ore screening plant, screening the ROM material relative to a threshold size wherein the threshold size is a feed size of one or more flotation cells at a surface processing plant, mixing 'fines' material, comprising ROM material that is below the threshold size, with a saturated brine to create a slurry mixture wherein the saturated brine prevents the 'fines' material from dissolving into the slurry mixture, and pumping the slurry mixture to a surface location via one of a shaft and a borehole to the surface product separation plant.

13 Claims, 6 Drawing Sheets

(51) Int. Cl.

| | |
|---|---|
| *E21C 35/20* | (2006.01) |
| *E21B 43/29* | (2006.01) |
| *B07B 1/36* | (2006.01) |
| *B07B 1/46* | (2006.01) |
| *B01F 3/12* | (2006.01) |
| *B03B 5/34* | (2006.01) |
| *B03B 7/00* | (2006.01) |

(52) U.S. Cl.
CPC ..... *B01F 2003/1278* (2013.01); *B01F 2215/0081* (2013.01); *B03B 5/34* (2013.01); *B03B 7/00* (2013.01); *B07B 1/36* (2013.01); *B07B 1/4672* (2013.01); *B07B 2230/01* (2013.01); *E21B 43/29* (2013.01); *E21C 35/20* (2013.01)

(58) Field of Classification Search
USPC ..... 299/8, 18; 406/46, 47, 48, 49
See application file for complete search history.

(56) References Cited

U.S. PATENT DOCUMENTS

| | | | | |
|---|---|---|---|---|
| 3,137,650 | A * | 6/1964 | Smith | B03B 9/00 209/166 |
| 3,232,672 | A | 2/1966 | Gardner | |
| 3,244,455 | A | 4/1966 | Condolios | |
| 3,384,419 | A | 5/1968 | Anderson et al. | |
| 3,407,004 | A | 10/1968 | Every et al. | |
| 3,485,534 | A | 12/1969 | Wanzenberg et al. | |
| 3,612,615 | A | 10/1971 | Water | |
| 3,790,214 | A | 2/1974 | Kilroy | |
| 3,918,916 | A * | 11/1975 | Garrett | B01D 9/0004 422/245.1 |
| 4,035,023 | A | 7/1977 | Cockrell | |
| 4,061,398 | A * | 12/1977 | Parkes | E21C 35/20 299/17 |
| 4,164,359 | A | 8/1979 | Karin et al. | |
| 4,251,108 | A * | 2/1981 | Nocke | E21F 13/042 299/18 |
| 4,411,474 | A | 10/1983 | Higgins | |
| 4,518,286 | A | 5/1985 | Vaupel et al. | |
| 4,915,452 | A | 4/1990 | Dibble | |
| 4,992,006 | A | 2/1991 | Drobadenko et al. | |
| 5,096,461 | A | 3/1992 | Frankiewicz et al. | |
| 5,195,851 | A | 3/1993 | Shepard et al. | |
| 6,428,245 | B1 | 8/2002 | Reid | |
| 2009/0206011 | A1 * | 8/2009 | Cudahy | B07B 1/005 209/365.3 |
| 2011/0311321 | A1 * | 12/2011 | Trueman | B65G 53/30 406/146 |
| 2017/0210573 | A1 | 7/2017 | Price et al. | |
| 2018/0073358 | A1 * | 3/2018 | Tivas | E21C 1/00 |
| 2019/0143337 | A1 * | 5/2019 | Filmer | B02C 23/20 |

FOREIGN PATENT DOCUMENTS

| | | | |
|---|---|---|---|
| GB | 184237 A * | 7/1922 | B03B 5/623 |
| WO | WO2014093584 | 6/2014 | |

OTHER PUBLICATIONS

PCT Search Report dated Jul. 9, 2019.

* cited by examiner

HYDRAULIC HOISTING OF POTASH AND OTHER EVAPORITE ORES

FIELD OF TECHNOLOGY

The present specification relates generally to evaporite ore mining, and more particularly, to methods of hydraulic hoisting of potash, polyhalite, trona and other similar evaporite ores from underground mines.

BACKGROUND

In underground potash and comparable evaporite mines, conventional mining operations typically engage extensive ore extraction and transportation equipment, and highly skilled personnel. Boring machines cut and move the ore away from the mining faces. The extracted ore is conveyed to the vicinity of the mine shaft and then hoisted to surface in open-topped containers called skips.

The tonnages and depths from which evaporite ores are hoisted typically require many years to construct and significant capital investment. In Saskatchewan, for example, potash ore hoisting is typically accomplished through concrete lined shafts 16 ft or more in diameter and approximating 3,000 ft deep. The shafts are fitted with about 200 ft-300 ft high headframes required to deflect the hoist ropes and house ancillary equipment. The hoists or winders utilized to raise and lower the skips are approximately 20 ft in diameter and have a hoist motor nominal of 10,000 kW.

It is a challenging problem to increase, on an incremental basis, the output from a mine that has reached or is approaching its maximum mechanical/electrical hoisting capacity. In such cases, increasing mine output would normally require construction and operation of another mine shaft at a very high cost. Operators must pay not only the costs of additional underground equipment and personnel, but also the large ultimately sunk capital cost of the hoisting plant. The cost of the hoisting plant is often a significant drawback to increasing mine production because it is both a large potential capacity increase in the hoisting rate and a prohibitive capital cost.

This and other drawbacks associated with conventionally-sought approaches to increasing the hoisting rate of underground mines are addressed by the methods disclosed herein.

Hoisting of potash ore with saturated brine has been conducted to examine plugging of the hoist pipe (Shook, C A; Gillies, R G and Schergevitch, P J. *Concentration Changes in Hydraulic Hoisting of Potash Ore*. In: International Conference on Bulk Materials Storage, Handling and Transportation (4th: 1992: Wollongong, N. S. W.)).

Improved methods of hoisting potash, polyhalite and other evaporite ores from underground mines are desirable.

The preceding examples of the related art and limitations related to it are intended to be illustrative and not exclusive. Other limitations of the related art will become apparent to those of skill in the art upon a reading of the specification and a review of the drawings.

BRIEF DESCRIPTION OF THE DRAWINGS

The described embodiments may be better understood by reference to the following description and the accompanying drawings. Additionally, advantages of the described embodiments may be better understood by reference to the following description and accompanying drawings.

DETAILED DESCRIPTION

Representative applications of methods according to the present application are described in this section. These examples are being provided solely to add context and aid in the understanding of the described embodiments. It will thus be apparent to one skilled in the art that the described embodiments may be practiced without some or all these specific details. In other instances, well-known process steps have not been described in detail to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the scope of the described embodiments.

The following describes an exemplary method for hydraulically hoisting potash (or other evaporite ore) 'fines' material from an underground mine. The method includes mining an ore deposit using a boring machine to generate Run-of-Mine (ROM) material at a mine face, conveying the generated ROM material to an underground dry ore screening plant, screening the ROM material relative to a threshold size wherein the threshold size is a feed size of one or more flotation cells at a surface wet product separation plant, mixing 'fines' material, comprising ROM material that is below the threshold size, with a supply of saturated brine to create a slurry mixture wherein the saturated brine prevents the 'fines' material from dissolving into the slurry mixture, and pumping the slurry mixture to the surface via one of a shaft and a borehole to the surface wet product separation plant.

Figure 1:
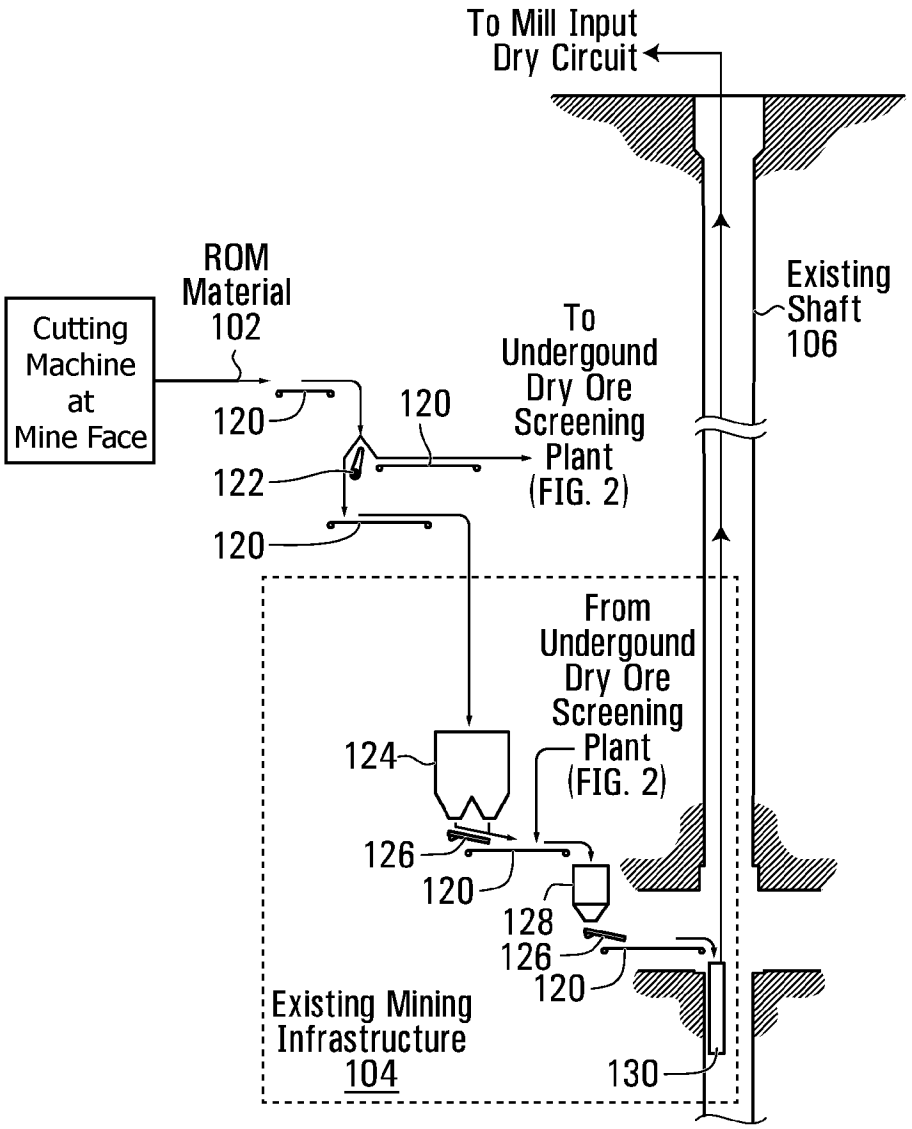
FIG. 1 is a vertical sectional elevation view through a shaft of an ore hoisting circuit in accordance with an example.

With reference to FIG. 1, an ore hoisting circuit is shown in accordance with one example. According to this example, "Run-of-mine "(ROM) material 102 is mined and transported on conveyor belt 120 where it is fed, via flop gate 122, to an underground dry ore screening plant 108 (shown in FIG. 2) for screening (and as discussed below, for hydraulic hoisting of 'fines' material). After screening, oversize or 'coarse' material is returned via conveyor belt 120 from the underground dry ore screening plant 108 to the existing mining infrastructure 104 for skipping to the surface. In this example, conveyor belts 120 are configured with feeders 126, and ROM or 'coarse' material can be stored temporarily in storage bins 124 and surge bins 128 as necessary to maintain and/or regulate the output of the production line. The returned 'coarse' material is loaded on skips at a loading pocket 130 for mechanical hoisting to the surface through an existing shaft 106. The hoisted 'coarse' material is conveyed to a (surface) mill input dry circuit for milling.

Figure 2:
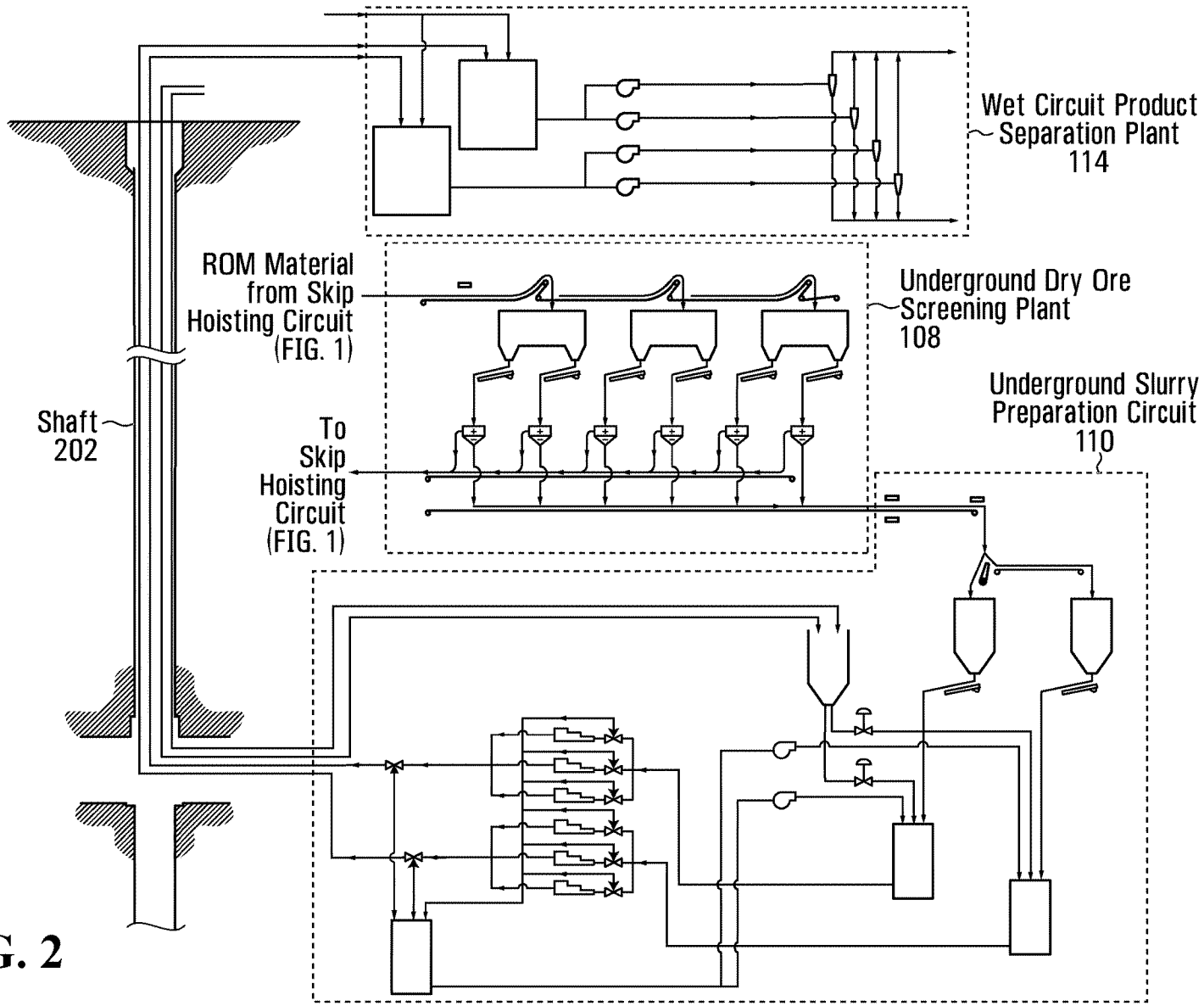
FIG. 2 is a vertical sectional elevation view through a shaft of a hydraulic hoisting circuit in accordance with an example.

Turning to FIG. 2, a hydraulic hoisting circuit is shown according to one example. The hydraulic hoisting circuit includes an underground dry ore screening plant 108 (described with reference to FIG. 4), an underground slurry preparation circuit 110 (described with reference to FIG. 5), and a (surface) wet product separation plant 114 (described with reference to FIG. 3). Generally speaking, the underground dry ore screening plant 108 separates and directs the 'coarse' material to the ore hoisting circuit of FIG. 1 and conveys the 'fines' material to the underground slurry preparation circuit 110 for hydraulic hoisting (as described below, what is hoisted is a slurry mixture made up of a saturated brine laden with the 'fines' material) to the surface via a shaft or shafts 202 (which may be the existing shaft 106 in one example). Alternatively, hydraulic hoisting of the slurry mixture can be via one or more boreholes, instead of the existing shaft. The hydraulic hoisting can be to a vertical height approximating 3,000 ft. After the slurry mixture has been hoisted to the surface, a wet product separation plant 114 separates the potash (or other ore) from the slurry mixture. There is no technical limit to the vertical height of the hoisting, either above or below the stated 3,000 ft.

In general, mine output is typically restricted within one or more constraints. For example, a typical mechanical/electrical hoisting system uses a drum or friction type hoist with a finite maximum hoisting capacity. This finite hoisting capacity is determined by factors such as available hours of operation, depth of hoisting and is contingent on a power connection to the hoist motor. These factors determine the amount of material that can be hoisted in an existing shaft and headframe on an hourly and annual basis.

In accordance with examples of the present specification, mining output of ore can be increased within the constraints of the existing mechanical/electrical hoisting plant by differentiating the 'fines' material from the 'coarse' material. The 'fines' material is mixed in a saturated brine solution and hydraulically hoisted by pumping while the 'coarse' material is hoisted as part of the existing skip hoisting system and up to the full capacity of that existing hoisting system.

Advantageously, by screening the ROM material 102 via an underground dry ore screening plant 108, examples of the present specification enable the hydraulic hoisting of 'fines' material in parallel with (or in lieu of, as the case may be) the skipping of 'coarse' material, allowing for the increasing of mine output on an incremental basis. This is in contrast to some previous approaches in which all ROM material is skipped to surface. Advantageously, techniques of the present specification permit increasing the output from a mine that is producing at or near existing hoisting plant infrastructure capacity.

The skilled reader will appreciate that one example of the present specification is directed to a method of hydraulically hoisting potash 'fines' material from an underground mine working level to a surface processing plant via an existing shaft 106. However, the present specification is not limited to the mining of potash ores but also extends to polyhalite ores or any evaporite mineral ores, crushed or fragmentary rock or other 'fines' material that is capable of being hydraulically hoisted. The disclosed techniques can be applied to any evaporite-type deposits in addition to potash deposits. For example, the present specification can be applied to any deposits that are mined using boring machines that generate ROM material (including 'fines' material that is generated by virtue of the mining method at the face).

The term potash refers to potassium compounds and potassium-bearing materials, the most common being potassium chloride (KCl). Potash is most commonly used as a fertilizer and in some other industrial applications as well.

According to one example, the typical potash ore ROM material 102, produced by a continuous face borer (also known as a continuous mining machine), is sized at 76,200 μm×0 μm (approximately 3 in×0 in). After comminution at the surface crushing/screening plant, a typical feed size to mill is 100% minus 3,360 μm. The ROM material, as produced by the continuous mining machinery, contains approximately 50% that falls within the required mill feed size range, and therefore, does not require any further size reduction.

In accordance with one example in the present specification, potash 'fines' material is material passing under a threshold size of about 3,360 μm and potash 'coarse' material is material equal to and greater than the threshold size of about 3,360 μm. The present specification is not limited to these dimensions; other values or ranges of values are intended to be covered by the present specification. The size can be selected or adjusted using the vibratory screen 412 discussed below with reference to FIG. 4. In one example, the threshold size is selected to be no greater than a feed size to the flotation cells in a wet product separation plant 114 or other surface processing plant. Advantageously, controlled selection of the threshold size may reduce the amount of materials handling at the wet product separation plant 114 or other surface processing plant.

In accordance with one example, the method of the present specification separates the ROM material 102 into two (2) size particle size streams underground—'coarse' or oversize material (e.g., at 2,830 μm or greater) and 'fines' or undersize material (e.g., at 100% minus 2,830 μm). According to one example, the vibratory screen 412 can be set at ⅛ in (3,175 μm) to enable the 2,830 μm material to pass as 'undersize'. The 'coarse' material is skipped to surface in the existing mechanical/electrical hoisting plant and the 'fines' material is pumped to surface using positive displacement pumps. The term 'undersize' in the present specification refers to that size which is suitable for feeding to flotation cells of a surface mill with no further size reduction.

As the screening operation produces the two particle size streams simultaneously, skipping and pumping also have to occur simultaneously, except for short periods that any storage capacity for either material size will allow. This means that, after a hoisting plant has reached its maximum capacity; there is still the ability to add another increment to the mine output, in the same shaft without affecting the existing mechanical/electrical hoisting system. This represents an increase in mine output above the current shaft hoisting capacity, with no change to the mechanical/electrical hoisting plant.

The maximum potential 'undersize' that can be made available for hydraulic hoisting and the quantity of that undersize is a function of the screening efficiency in separating the ROM material into the particle streams at the designated split size. In one example, the 'undersize' potash ore pumped to the surface can be introduced into an existing potash processing circuit after the 'oversize' potash ore is crushed and screened (i.e., in an existing plant) and prior to scrubbing.

The ratio of the 'fines' material to the 'coarse' material in the ROM material 102 from the mine workings is a function of the nature of the deposit and the mining method and equipment.

Figure 3:
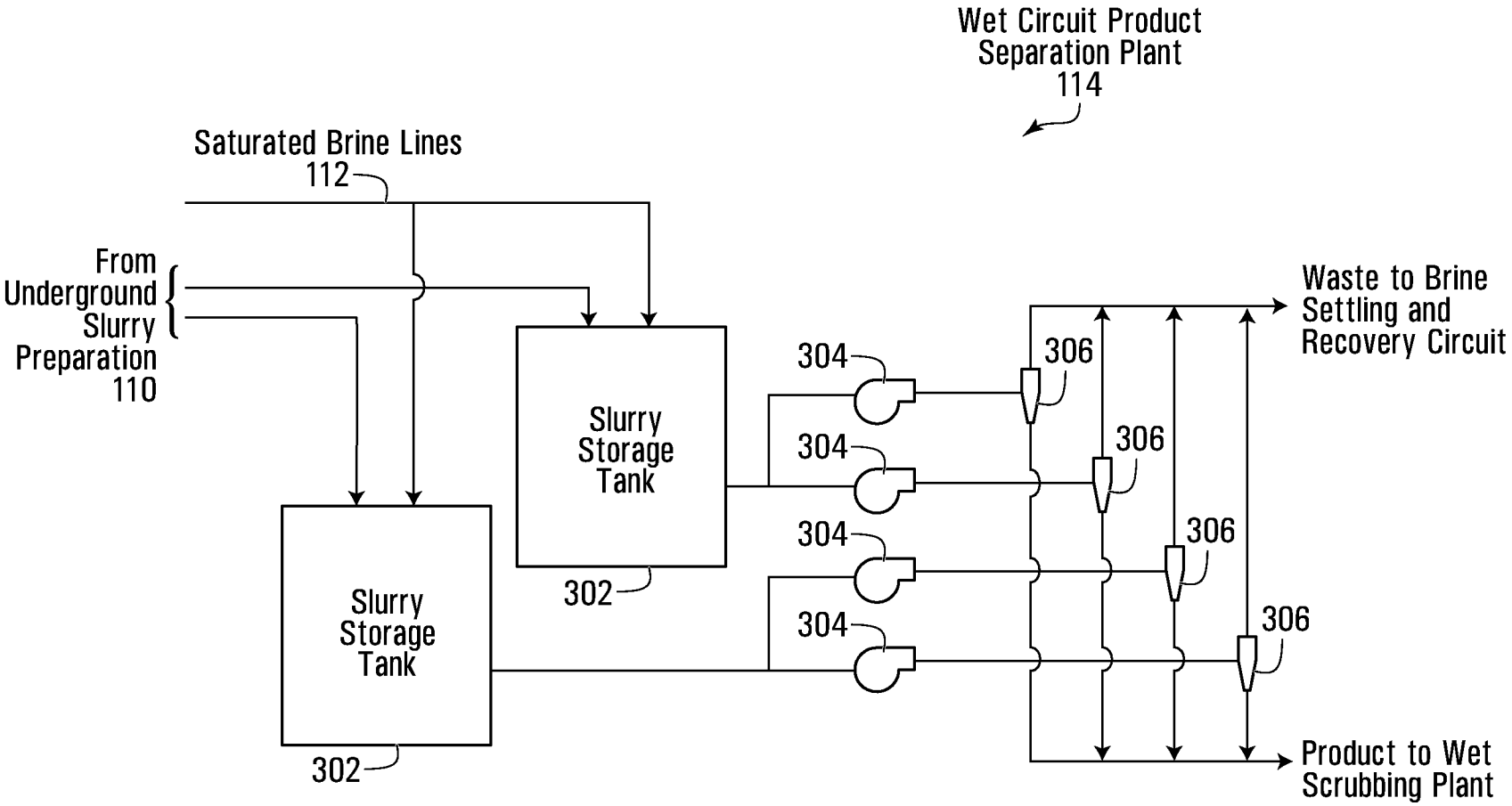
FIG. 3 is an elevation view of a wet product separation plant in the hydraulic hoisting circuit of FIG. 2.

FIG. 3 illustrates a (surface) wet product separation plant 114 in accordance with an example. After hoisting, the slurry mixture is stored in surface atmospheric pressure discharge tanks 302. Centrifugal pumps 304 pump the slurry mixture through a bank of hydro cyclones 306—waste is pumped to a brine settling and recovery circuit (not shown) and product is sent for scrubbing (i.e., to an existing and expanded capacity wet scrubbing plant (not shown)).

Figure 4:
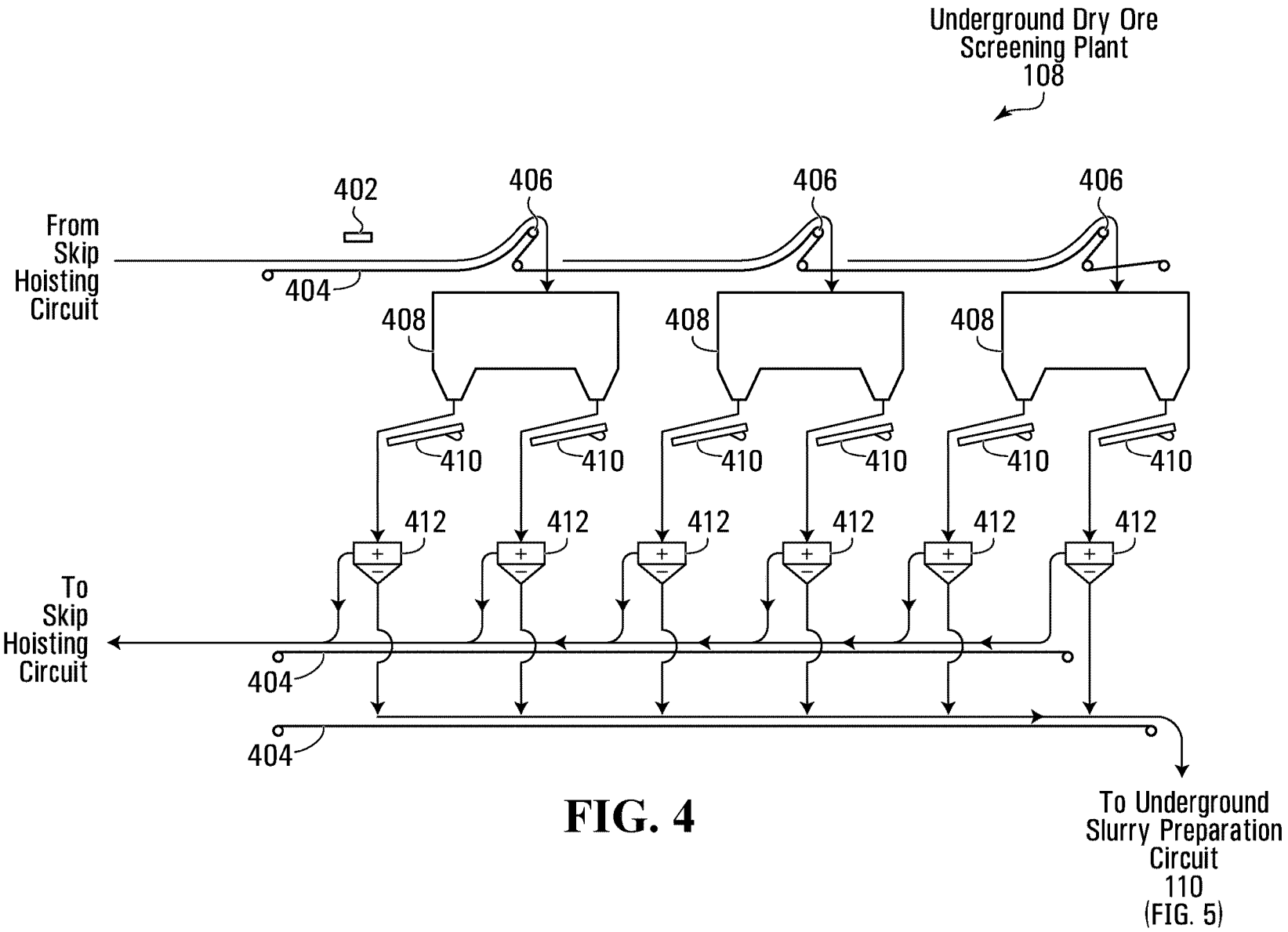
FIG. 4 is an elevation view of an underground dry ore screening plant in the hydraulic hoisting circuit of FIG. 2.

FIG. 4 illustrates an underground dry ore screening plant 108 in accordance with an example. In this example, ROM material 102 travels along conveyor belt 404 which may be fitted with one or more magnets 402 to move the ROM material 102 throughout the production line. The production line can also include one or more trippers 406 and surge bins 408. The ROM material 102 is fed via one or more feeders 410 to vibratory screens 412. The vibratory screens 412 direct undersize or 'fines' material to the underground slurry preparation circuit 110, while oversize or 'coarse' material is directed to the ore hoisting circuit (FIG. 1), using conveyor belts 404.

In this specification, a vibratory screen 412 encompasses any screening machine including a drive that induces vibration, a screen cloth that causes particle separation, and a deck which holds the screen cloth and the drive and is the mode of transport for the vibration. The vibration can be sinusoidal or gyratory. The screen cloth or media is defined by aperture (mesh) size, and can be made of any type of material such steel, stainless steel, rubber compounds, polyurethane, brass, etc. Though the present specification uses the term "vibratory screen", it will be appreciated that this term extends to any other technique of mechanical separation of ROM material 102 into one or more channels or streams of the ROM material 102. According to one example, the apertures can be defined by reference to a flowsheet of the (surface) wet product separation plant 114.

Figure 5:
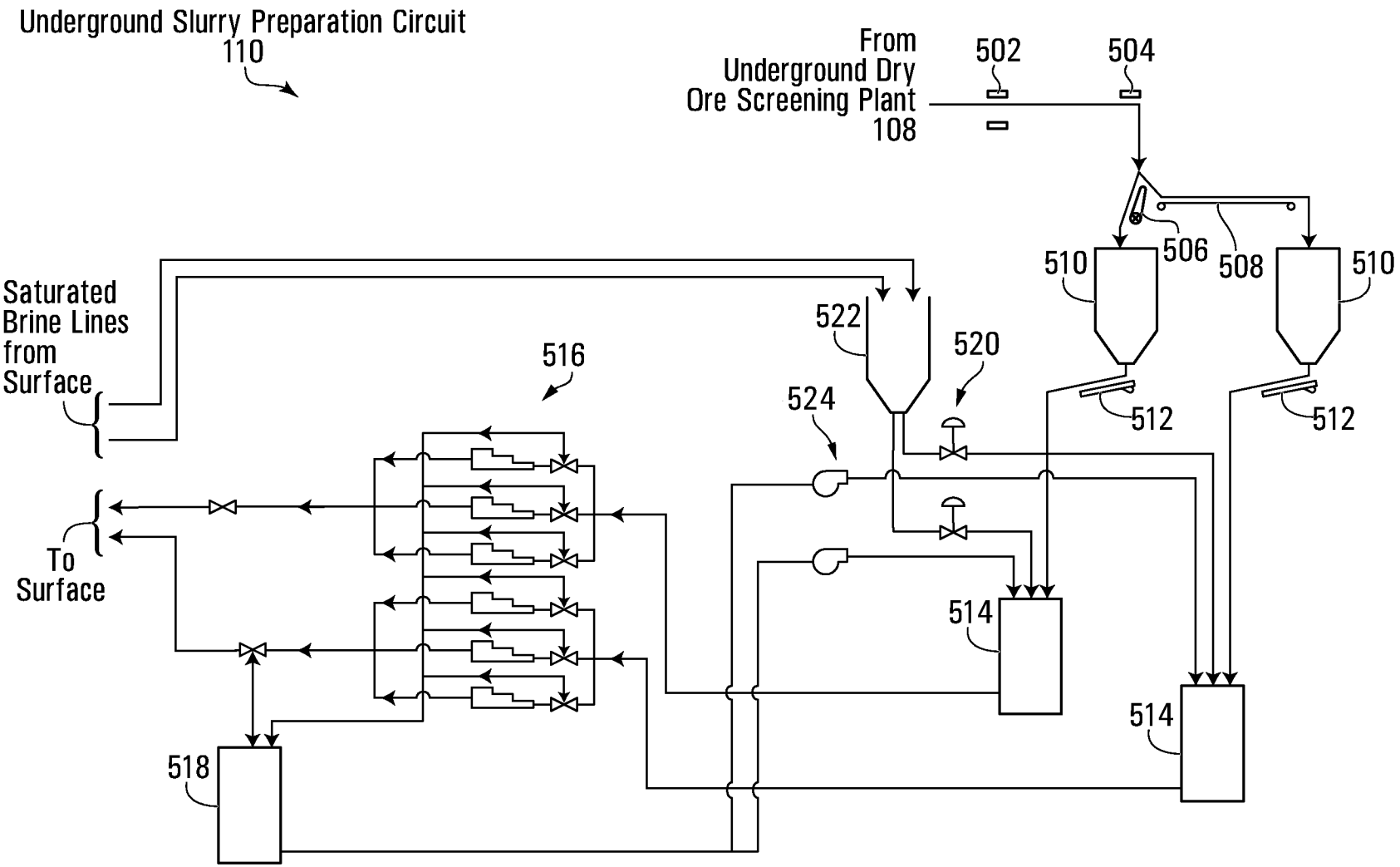
FIG. 5 is an elevation view of an underground slurry preparation circuit in the hydraulic hoisting circuit of FIG. 2.

FIG. 5 illustrates an underground slurry preparation circuit 110 in accordance with an example. 'Fines' material from the underground dry ore screening plant 108 is loaded into one or more agitated storage tanks 514, after being conveyed through one or more metal detectors 502, magnets 504, flop gates 506, conveyor belts 508, surge bin 510 and feeders 512, and mixed (using valves 520) with a supply of saturated brine kept in a surge tank 522 supplied by a line or lines from the surface. The mixture or slurry of saturated brine and 'fines' material is pumped using positive displacement pumps 516 to the surface via the shaft 202. In accordance with one example, the storage tanks 514 will include agitators (not shown) that maintain the solids of the slurry mixture in homogeneous suspension. An agitated slurry holding tank 518 (also called a dump tank) positioned at the bottom of the shaft 202 (or boreholes) is configured to hold the slurry mixture in the event of a power loss and the need to vacate the vertical lines to the surface.

Advantageously, the use of a saturated brine, rather than an unsaturated brine or water, as the conveyance medium for the hydraulic hoisting prevents the 'fines' material from dissolving in the slurry mixture. Use of unsaturated brine will partly dissolve the potash 'fines' material in the mixture en route to the surface in the pipeline, an undesired result. As used in the present specification, the term "dissolving" refers to the process of mixing or combining a solute and a solvent to form into a solution which cannot be separated by a simple process like filtration. The skilled reader will appreciate that the extent of solubility can vary and that expressions such as "prevent a solute from dissolving" mean that a solute is practically or slightly insoluble in a given solvent.

According to one example, saturated brine is the required medium to prevent the potash ore from dissolving into solution. Clarified saturated brine from an existing thickener overflow circuit on the surface (not shown) can be directed to and then down the shaft (or boreholes) in one or more steel pipes.

More generally, in the present specification, use of the term brine encompasses a high-concentration solution of salt (e.g., sodium chloride and/or potassium chloride) and saturated refers to a solution containing the maximum (or substantially maximum) possible amount of a dissolved salt.

To provide the transport medium for pumping the 'undersize' material (e.g. potash ore material) to the surface requires that a steady and reliable supply of saturated brine is provided to the pumps 524 which may be positive displacement pumps or any other type of pump that is known. In one example, the source of the saturated brine can be the surface processing plant (in conventional surface scrubbing circuits, brine is added to crushed ore in a series of agitated tank cells to dislodge impurities from the potash).

In accordance with the present specification, the slurry mixture is prepared through the continuous mixing of the 'fines' material with the saturated brine from the surface in storage tanks 514 located adjacent to the pumps 524. FIG. 5 shows two storage tanks 514 for the slurry mixing, each sized to serve two pumps 524, but variations to such arrangement are possible without departing from the scope or intent of the present specification.

According to one example, the maximum mine design output is potash ore contained in a slurry mixture at a consistency of up to about 60% solids by weight. The slurry mixture can be mixed up to about 60% solids by weight by metering from a (dry solids) 'undersize' material surge bin 510 and a saturated brine surge tank 522, both ahead of the slurry mixing storage tanks 514.

According to one example, agitators (not shown) disposed in the storage tanks 514 work to maintain the solids of the slurry mixture in homogeneous suspension at all times. The percentage solids in the tanks can be monitored continuously by using a small pumped sampling loop and gamma gauge. In one example, the storage tank 514 can be sized to retain sufficient slurry for 30 minutes of pumping at full capacity. This can then size each tank to hold a measure of dry solids in slurry form at up to about 60% solids by weight. In the event of a power or equipment failure, the agitator can be designed to remobilize the fully loaded slurry tank after solids settling. The pumps 524 can be arranged in two groups of two (or three) pumps per slurry pipeline (not shown).

In the event that power is lost whilst the slurry mixture is in transit between the pumps 524 and the surface processing plant, the entire contents of the slurry pipeline can be dumped or unloaded into a slurry holding tank 518 near the shaft bottom to avoid the solids settling in the pipe. To mitigate this risk, the pumps 524 cam be connected to an emergency power source, even if the pumps 524 have to operate at a lower capacity. The aim is to prevent the mean slurry velocity, in both the vertical and horizontal sections of the pipeline, from being less than the critical settling velocity of the particles. Whilst solids settling in the horizontal or sub vertical pipelines can re-mobilize readily upon the pumps 524 restarting, the same may not necessarily be said for the vertical pipelines. Solids settlement in the vertical section may eventually resemble a 'plug' of material which may be expected to approach solidification with time. This cannot be allowed to occur. The 'dumped' slurry can be held in the slurry holding tank 518 and re-introduced into the slurry circuit at the earliest possible time in order to maintain an empty slurry holding tank 518 for emergencies.

The pumps 524 can pressurize the slurry lines sufficiently to enable the slurry to be transported to two surface atmospheric pressure discharge tanks 302, each with an agitator (not shown). The function of the tanks 302 is to prevent any back pressure or varying pressure on the pumps 524. Each tank 302 can be sized for 30 minutes retention time, or some other suitable measure, at full mine output rate. Each tank 302 can be equipped with centrifugal pumps 304 and a bank of hydro cyclones 306, to concentrate the solids as suitable feed to a scrubbing section of the plant (not shown) and send the clarified overflow to a thickening circuit (not shown).

Figure 6:
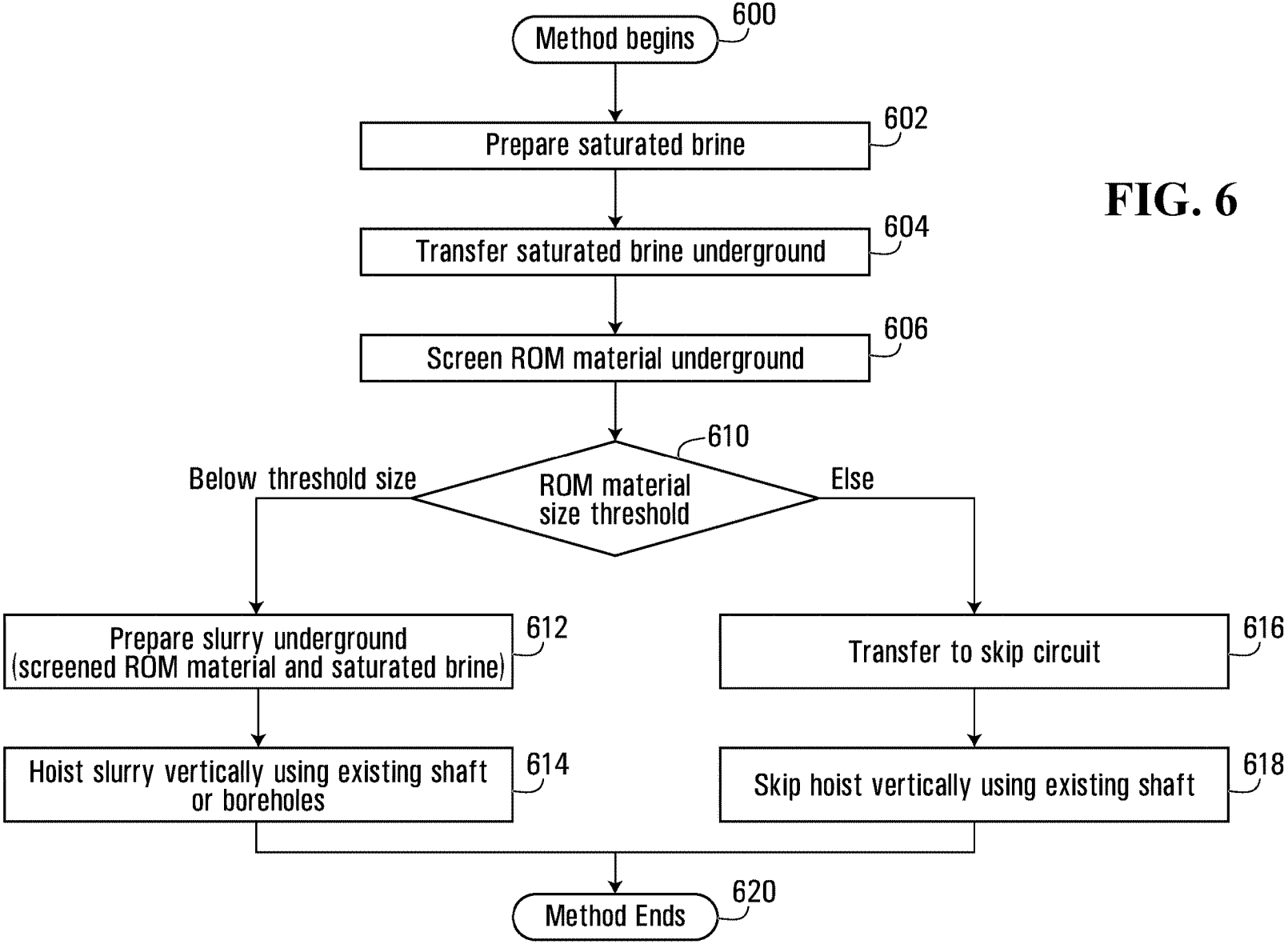
FIG. 6 is a flowchart illustrating a method of hydraulic hoisting of potash ore in accordance with an example.

A flowchart illustrating an example of a method of hydraulically hoisting potash 'fines' material from an underground mine is shown in FIG. 6. The method may be carried out by using the plant described with reference to FIG. 1 through FIG. 5. Implementing such a method is within the scope of a person of ordinary skill in the art given the present description. The method may contain additional or fewer processes than shown and/or described, and may be performed in a different order.

At 600 of FIG. 6, the method begins. A saturated brine is prepared at 602 and is transported underground at 604. ROM material is mined. At an underground dry ore screening plant 108, the ROM material is screened at 606. The undersize or 'fines' material, relative to a threshold size (shown at 610), is mixed with a saturated brine to prepare a slurry mixture at 612. The slurry mixture is hoisted to the surface at 614 via a shaft or a borehole. Oversize or 'coarse' material is transferred to a skip circuit at 616 and is mechanically hoisted to the surface at 618. The method ends at 620.

The present specification discloses a method of hydraulically hoisting potash 'fines' material from an underground mine including the steps of mining a potash ore deposit using a boring machine to generate a ROM material at a mine face, conveying the generated ROM material to an underground ore screening plant, screening the ROM material relative to a threshold size wherein the threshold size is a feed size of one or more flotation cells at a surface product separation plant, mixing 'fines' material, comprising the ROM material that is below the threshold size, with a saturated brine to create a slurry mixture wherein the saturated brine prevents the potash 'fines' material from dissolving into the slurry mixture, and pumping the slurry mixture to a surface location via one of a shaft and a borehole to the surface product separation plant.

According to one example, the screening step includes passing the ROM material through a plurality of sized apertures within a vibrating screen cloth. The apertures can be sized based on potash ore flotation characteristics determined by a flowsheet of the surface product separation plant. According to one example, the apertures can be sized at about ⅛ in.

The saturated brine can be a mixture of sodium chloride and potassium chloride salts, in accordance with one example.

The mixing can include agitating the slurry mixture in tanks to maintain solids of the slurry mixture in homogeneous suspension and to prevent settling. The pumping can include moving the slurry mixture through pipes using one or more positive displacement pumps that are pressurized to transport the slurry mixture through the pipes to a surface atmospheric pressure discharge tank. In the event of a power loss, the method can include dumping the slurry mixture in a slurry holding tank near a shaft bottom to prevent settling in the pipes.

According to an example, the saturated brine can be from an existing thickener overflow circuit (not shown) at the surface product separation plant.

The mixing step can be performed underground. The saturated brine can descend for underground mixing in one or more pipes.

According to one example, the coarse material is conveyed to a circuit for skip hoisting. According to this example, the hydraulic hoisting (pumping) and the skip hoisting can be performed substantially simultaneously in parallel to increase a rate of output of mine operations. And, when the skip hoisting is substantially at capacity, the hydraulic hoisting augments production to increase an overall capacity of the rate of output of mine operations.

The present specification also discloses the use of a saturated brine for hydraulic hoisting by mixing the saturated brine with potash 'fines' material including screened ROM material from an underground mine to create a slurry mixture. The saturated brine prevents the potash 'fines' material from dissolving into the slurry mixture. The saturated brine can be a mixture of sodium chloride and potassium chloride salts.

The present specification further discloses a method of hydraulically hoisting 'fines' material from an underground mine including the steps of mining a deposit using a boring machine to generate ROM material at a mine face, conveying the generated ROM material to an underground (e.g., dry) ore screening plant, screening the ROM material relative to a threshold size wherein the threshold size is a feed size of one or more flotation cells at a surface wet product separation plant, mixing 'fines' material, comprising the ROM material that is below the threshold size, with a saturated brine to create a slurry mixture wherein the saturated brine prevents the 'fines' material from dissolving into the slurry mixture, and pumping the slurry mixture to the surface via one of a shaft and a borehole to the surface (e.g., wet) product separation plant.

It will be recognized that while certain features are described in terms of a specific sequence of steps of a method, these descriptions are only illustrative of the broader methods disclosed herein, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the disclosure and claimed herein.

Furthermore, the various aspects, embodiments or features of the described embodiments can be used separately or in any combination.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

The invention claimed is:

1. A method of hoisting potash from an underground mine comprising the steps of:

mining a potash ore deposit using a mechanical cutting machine to generate a Run-of-Mine (ROM) material at a mine face;

conveying the generated ROM material to an underground dry ore screening plant;

at the underground dry ore screening plant, splitting the ROM material into a first stream and a second stream relative to a threshold size wherein the threshold size determines the maximum size of the ROM material to be hydraulically hoisted;

mixing the first stream of fines material, comprising the ROM material that is below the threshold size, with a saturated brine to create a slurry mixture, wherein the saturated brine is formulated to prevent the potash fines material from dissolving into the slurry mixture;

positive displacement pumping to drive, vertically and under high pressure, the slurry mixture to a surface location via a mine exit selected from one of: a shaft; and at least one borehole, to a surface product separation plant; and conveying the second stream of coarse material, comprising the ROM material that is not below the threshold size, to a circuit for vertical skip hoisting, the circuit having a capacity that is available to the coarse material, wherein the coarse material is kept dry to facilitate conveyance, transfer and vertical skip hoisting; and wherein the pumping and the skip hoisting is performed substantially simultaneously in parallel to increase a mine hoisting output rate.

2. The method of claim 1 wherein the splitting comprises passing the ROM material in a direction selected from one of: over; and through a vibratory screen.

3. The method of claim 2 wherein the vibratory screen comprises apertures that are sized based on potash ore flotation characteristics of a surface wet product separation plant.

4. The method of claim 3 wherein the apertures are sized at about ⅛ in.

5. The method of claim 3 wherein the saturated brine is transported to the underground ore screening plant from the surface wet product separation plant.

6. The method of claim 1 wherein the saturated brine comprises a mixture of sodium chloride and potassium chloride salts.

7. The method of claim 1 wherein the mixing comprises agitating the slurry mixture in tanks to maintain solids of the slurry mixture in homogeneous suspension and to prevent settling.

8. The method of claim 1 wherein the pumping comprises moving the slurry mixture through pipes using one or more positive displacement pumps that transport the slurry mixture through the pipes to a surface atmospheric pressure discharge tank.

9. The method of claim 8 further comprising the step of, in the event of a power loss, dumping the slurry mixture in a slurry holding tank near a shaft bottom elevation to prevent settling in the pipes.

10. The method of claim 1 wherein the mixing step is performed underground, and the saturated brine descends for underground mixing in one or more pipes.

11. The method of claim 1 wherein when skip hoisting is substantially at capacity, hydraulic hoisting augments production to increase an overall capacity of the mine hoisting output rate.

12. Use of a saturated brine for hydraulic hoisting, the hoisting consisting essentially of mixing the saturated brine with potash fines material comprising ROM material from an underground mine separated at an underground dry ore screening plant into a first stream of material that is below a threshold size to create a slurry mixture wherein the saturated brine is formulated to prevent the potash fines material from dissolving into the slurry mixture; and positive displacement pumping to drive, vertically and under high pressure, the slurry mixture to the surface substantially in parallel with skip hoisting of a second stream of coarse material not below the threshold size, and the coarse material is kept dry to facilitate conveyance, transfer and vertical skip hoisting, to increase a mine hoisting output rate.

13. Use of the saturated brine of claim 12 wherein the saturated brine comprises a mixture of sodium chloride and potassium chloride salts.

* * * * *